United States Patent [19]

Zinz, Sr.

[11] 4,278,066

[45] Jul. 14, 1981

[54] FLIPPER REST

[76] Inventor: Alvin G. Zinz, Sr., R.D. #3, Lamberton Rd., Franklin, Pa. 16323

[21] Appl. No.: 64,840

[22] Filed: Aug. 8, 1979

[51] Int. Cl.[3] ..... F41B 5/00

[52] U.S. Cl. ..... 124/41 A; 124/24 R

[58] Field of Search ..... 124/41 A, 24 R, 35 A, 124/88

[56] References Cited

U.S. PATENT DOCUMENTS 4,170,980 10/1979 Killian ..... 124/41 A

*Primary Examiner*—Richard C. Pinkham
*Assistant Examiner*—William R. Browne
*Attorney, Agent, or Firm*—Charles L. Lovercheck

[57] ABSTRACT

An arrow support made of a lever pivoted in a slot. The lever is urged out of the slot by a weak spring and it is positioned outside the slot to support the arrow. The arrow passing the lever swings the lever into the slot out of the way of the arrow without deflecting the arrow. The spring has an eyelet, an intermediate part and an end part so related that they urge the lever to swing outward to support an arrow.

10 Claims, 9 Drawing Figures

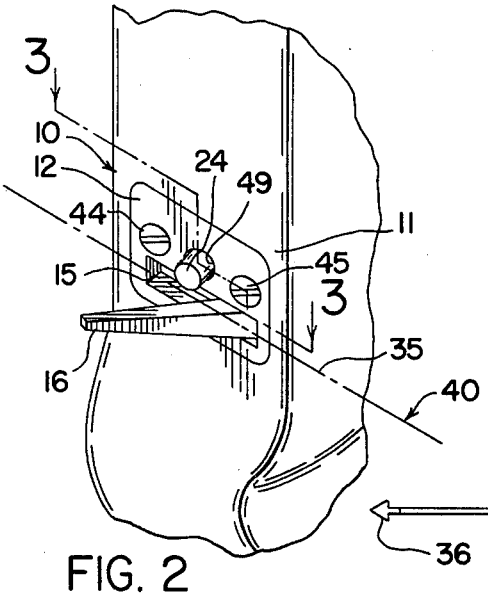
FIG. 2
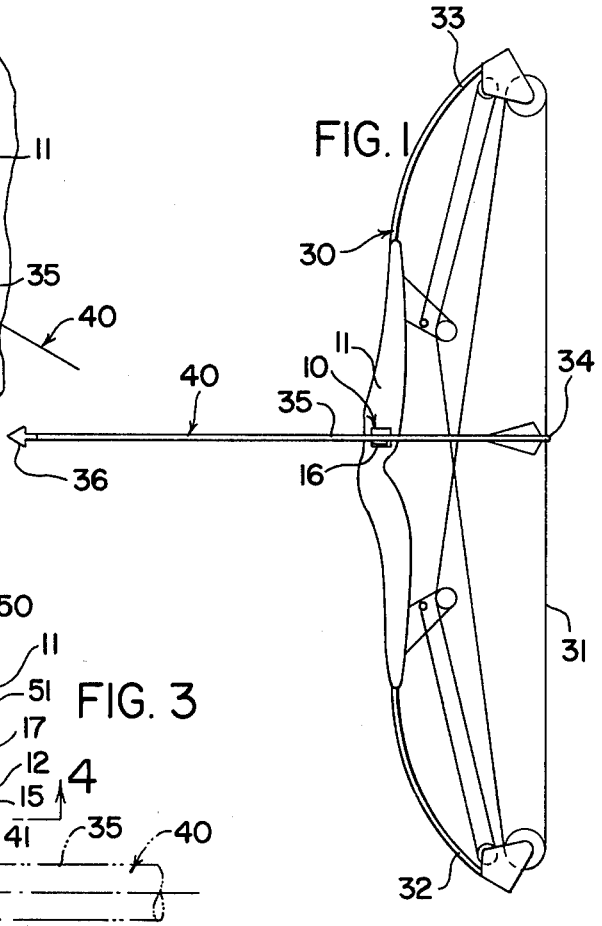
FIG. 1
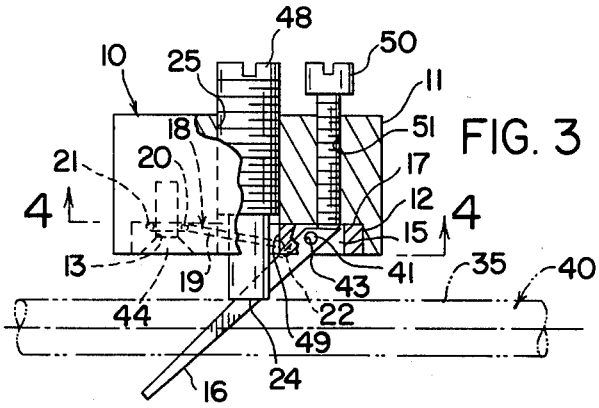
FIG. 3
FIG. 4
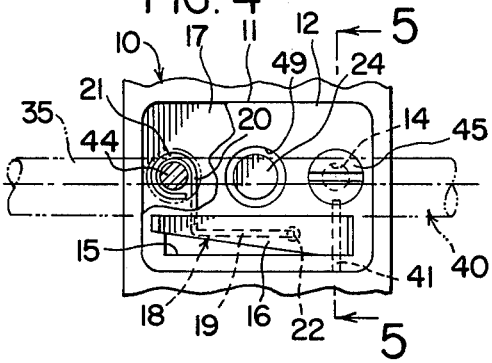
FIG. 5
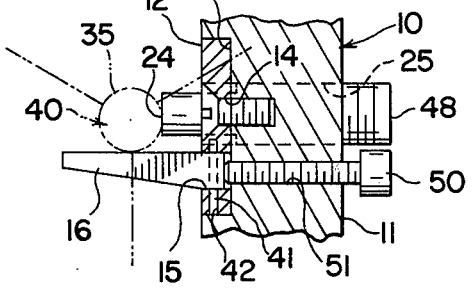

FLIPPER REST

REFERENCE TO PRIOR ART

U.S. Pat. No. 3,225,755 shows an arrow rest made up of bristle elements aligned in a group having a greater length than width. The bristles do not swing into a slot.

U.S. Pat. No. 3,342,173 shows an arrow rest with a magnetic means on the rest that will attract magnetic means on the bow to normally retain the rest in laterally extended position. The magnet is more inclined to deflect the arrow than applicant's spring.

U.S. Pat. No. 3,865,096 shows an arrow rest wherein a free-standing spring is deflected by the arrow and the arrow rest does not swing into a slot out of the way of the arrow as applicant's does.

OBJECTS OF THE INVENTION

It is an object of the invention to provide an improved arrow rest.

Another object of the invention is to provide an arrow rest that is simple in construction, economical to manufacture and simple and efficient to use.

Another object of the invention is to provide an arrow rest which will swing completely out of the way of the arrow by a minimal force.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a side view of the arrow rest supported on a bow according to the invention.

FIG. 2 is an enlarged partial view of the arrow rest shown in FIG. 1.

FIG. 3 is a view partly in cross-section showing the arrow rest.

FIG. 4 is a side view of the arrow rest.

FIG. 5 is a longitudinal cross-sectional view of the arrow rest.

DETAILED DESCRIPTION OF THE DRAWINGS

Figure 6:
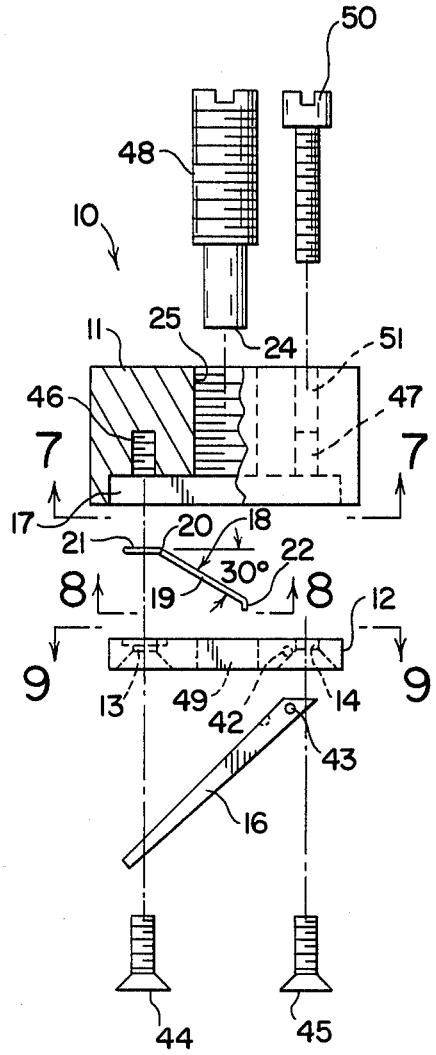
FIG. 6 is an exploded view of the arrow rest.
Figure 7:
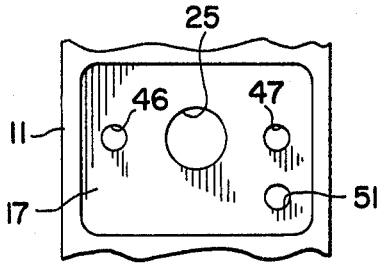
FIG. 7 is a side view of one part of the arrow rest.
Figure 8:
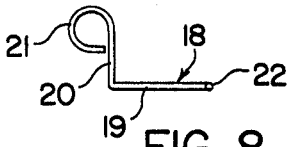
FIG. 8 is an enlarged view of the spring.
Figure 9:
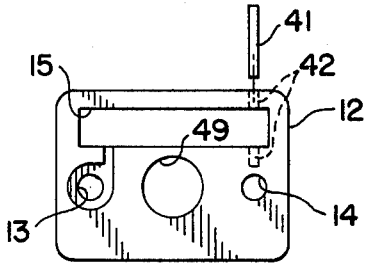
FIG. 9 is a top view of the inside of the arrow rest.

Now, with more particular reference to the drawings, the arrow rest 10, is shown on a bow 30, having a bow string 31 and an arrow 40. The arrow rest is made up generally of a rectangular block 11 having at least one flat side with a recess 17 formed in it that has a plate 12 closing it. The plate 12 has a first hole 13 and a second hole 14 formed therein and spaced from each other. A slot 15 is formed in the plate 12 and the slot is generally parallel to one side of the plate. A lever 16 is swingably supported in the slot to swing about one end and the lever is pivotedly connected at 16 to the plate 12 by means of the pin 41, which is pressed into the hole 42 in the block and extends through a hole 43 in the lever 16. A recess 17 is formed in the block 11 and the recess receives the plate 12. A spring 18 has an end part 19 and an intermediate part 20 and an eyelet 21 disposed at approximately 30° to end part 19. The eyelet 21 is disposed between the plate 12 and the block 11 and the end part 19 engages the lever 16 urging the lever to swing away from the block. The screws 44 and 45 extend through the holes 13 and 14 in the plate 12 and into the threaded holes 46 and 47 in the block. The adjusting screw 48 is threaded into the threaded hole 25 in the block 11 and it has an end 24 that extends through the hole 49 in the plate 12 and may be moved toward or away from the arrow to adjust it. The hole 14 is formed in the block 11 which may receive a screw for exerting a force on the plate 12 to regulate the force of the plate on the spring. The lever 16 forms a support for supporting one end of the arrow 40 on the bow 30. When the support 10 is attached to the bow 30 and the lever 16 is swung to outward position, the arrow 40 will rest on it as shown in FIG. 1. Then, the operator will fit the noc of the arrow at 34 onto the bow string 31, draw the bow and when he releases the bow string, the arrow will urge the lever 16 to swing into the slot 15 out of the way of the arrow without deflecting the arrow from its true path of flight. The screw 48 may be adjusted to sight in the bow and the screw 50 may be adjusted to regulate the angle of the lever 16 by moving the point of engagement toward the arrow, thereby swinging the lever further into the slot. The inner end of the screw 50 engages the end of the lever 16 as shown in FIG. 3.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A support for an arrow supported on a bow comprising, a rest (10), a block (11) having a generally flat side, a plate (12) having a generally flat side, said plate (12) having a first hole (13) and a second hole (14) formed therein and spaced from each other, a slot (15) formed in said plate and extending through said generally flat side, said slot being generally parallel to one side of said plate, a lever (16) swingably supported in said slot to swing about one end, pivot means connecting said lever (16) to said plate (12), a recess (17) in one side of said block (11) in said flat side face, said recess receiving said plate (12) with said generally flat side generally flush with said flat side face, a spring (18), said spring having an end part (19), an intermediate part (20), an eyelet (21), and spring end (22), the intermediate part (20) of said spring (18) being disposed at approximately 90° to said end part (19), said eyelet (21) being disposed at approximately 30° to said end part (19), said eyelet (21) being disposed between said plate (12) and said block (11) and said end part (19) engaging said lever (16), urging said lever (16) to swing away from said block (11) and a screw (44) extending through said second hole and through said eyelet (21), clamping said plate to said block, said lever forming a support for supporting one end of an arrow (40) on said lever (30).

2. The block recited in claim 1 wherein said block has a central threaded opening (25) therein and a positioning screw (48) threadably received in said central opening (25) for engaging and positioning said arrow (40) on said bow (30).

3. The bow recited in claim 2 wherein said bow (30) has a bow string (31) attached to said bow at its end (32,33), an intermediate part of said bow string (31) being adapted to engage an end (34) of an arrow, an intermediate part (35) of said arrow being adapted to rest on said lever and said arrow having a head (36).

4. An arrow rest and an arrow comprising a body adapted to be supported on a bow, slot means (15) in said body, a lever (16) in said slot, pivot means (41) swingably connecting said lever (16) to said body (10), a cantilever spring (18) having an eyelet (21) fixed on one end thereof, screw means (44) in said eyelet (21) holding said eyelet (21) rigidly to said body, an L-shaped intermediate spring part (19) fixed to said eyelet (21) and extending in cantilever fashion toward said lever (16), means (22) on said intermediate part (19) of said spring (18) engaging said lever (16) urging said lever (16) to swing outward from said body providing a rest for said arrow.

5. The arrow rest recited in claim 4 wherein said arrow has a longitudinal axis and said lever (16) extends from said pivot means (41) and at an acute angle from the longitudinal axis of said arrow.

6. The arrow rest recited in claim 5 wherein a second screw is disposed in said body having an end engaging said lever on the end remote from said intermediate part of said lever.

7. The arrow rest recited in claim 6 wherein a lateral extending screw is disposed in said body having an end extending over said lever and adapted to engage said arrow to position said arrow on said rest, said laterally extending screw being adjustable to move said arrow laterally on said rest.

8. The arrow rest recited in claim 7 wherein a plate is supported on said body, said slot is disposed in said plate and removal means attaching said plate to said body.

9. The arrow rest recited in claim 8 wherein said lever is swingably connected to said body by means of a pin extending through a hole in said plate and to a pivot point in said lever.

10. The arrow rest recited in claim 9 wherein said second mentioned screw engages an end of said lever remote from said intermediate part whereby the angle of said lever to said arrow can be adjusted.

* * * * *